US008065771B2

(12) United States Patent
Hui et al.

(10) Patent No.: US 8,065,771 B2
(45) Date of Patent: Nov. 29, 2011

(54) POOL CLEANING BRUSH

(76) Inventors: Wing-kin Hui, Hong Kong (HK); Fong-man Hui, Hong Kong (HK)

( * ) Notice: Subject to any disclaimer, the term of this patent is extended or adjusted under 35 U.S.C. 154(b) by 825 days.

(21) Appl. No.: 12/061,609

(22) Filed: Apr. 2, 2008

(65) Prior Publication Data

US 2008/0244843 A1 Oct. 9, 2008

(51) Int. Cl.
*E04H 4/16* (2006.01)

(52) U.S. Cl. ..... 15/1.7; 15/88.3

(58) Field of Classification Search ..... 15/179, 15/1.7, 176.1, 141.2, 183, 186, 187, 230.14, 15/230.16, 230.19, 201, 202
See application file for complete search history.

(56) References Cited

U.S. PATENT DOCUMENTS 2,757,401 A * 8/1956 Peterson ..... 15/182
3,245,518 A * 4/1966 Reibel et al. ..... 198/801
3,755,847 A * 9/1973 Liebscher ..... 15/179
5,016,311 A * 5/1991 Young et al. ..... 15/88.3
6,099,091 A * 8/2000 Campbell ..... 305/4
6,633,150 B1 * 10/2003 Wallach et al. ..... 318/568.12

* cited by examiner

*Primary Examiner* — Dung Van Nguyen
(74) *Attorney, Agent, or Firm* — Peninsula IP Group; Douglas Chaikin

(57) ABSTRACT

This invention discloses a roller brush used in swimming pool cleaner, including the roller body and the roller brush wrapped around the roller body. The inner side of roller brush in contact with the roller body outer surface. The roller body has a number of detent posts or grooves. The roller brush inner surface has a number of corresponding grooves or posts. Certain number of detent posts engages with grooves enable the roller brush and roller body positive interlock. For this reason, this roller brush invention allows positive and synchronize drive between roller body and roller brush, avoiding slipping drive. Moreover, this invention has simple construction, easy manufacture and assembly. This invention does not need to apply too much tension on the roller brush, reducing the flexible roller brush aging rate. It is therefore product life extended and maintenance cost lowered.

14 Claims, 4 Drawing Sheets

POOL CLEANING BRUSH

FIELD OF THE INVENTION

This invention relates to devices for cleaning a pool, which may be attached to a pool cleaning vehicle or the like. In particular, the invention relates to a roller brush assembly for use with a cleaning pool vehicle, which improves the ability of the vehicle to clean and encourages longer roller assembly life with less maintenance. The roller brush assembly is used in both consumer and industrial type swimming pools.

TECHNICAL BACKGROUND

Presently swimming pool cleaning devices typically include a roller brush assembly, wheels and/or a track and/or a chain placed at the bottom of the body. Such a roller brush assembly, wheels and/or track and/or chain are driven by an internal motor, or jet propelled by water pump placed inside or outside the swimming pool cleaning device. The swimming pool cleaning device can therefore move around at the swimming pool floor to vacuum and to clean the pool.

U.S. Pat. No. 5,001,800 discloses a swimming pool cleaning device as shown in FIG. 1. The cleaning device has an outer shell (2). The outer shell has a roller (20) and wheel (11) at its bottom (2*a*). Roller (20) and wheel (11) are driven by a motor placed inside the outer shell (2). By means of the roller (20) mechanical action, could effectively pick up dirt and debris settled at the swimming floor through the intake port (5) located on the bottom (2*a*) of the outer shell (20). The roller (20) generally consists of a rigid roller body and a flexible roller brush wrapped around the roller body.

The roller used in existing swimming pool cleaning devices as shown by example in FIG. 2 includes a rigid roller body (21) and a flexible roller brush (21) wrapped around the rigid roller body (21). The rigid roller body (21) axle is connected to a motor placed inside the swimming pool cleaning device and driven by this motor. The roller brush (22) has an inner surface in contact with the roller body (21) outer surface. The roller brush (22) outer surface has a number of flexible brushes sticking out. Such brushes are used to increase friction and stir up the dirt and debris, which has settled on the swimming pool floor.

To handle the above mentioned existing problems, known cleaning devices have been designed to raise the floor clearance as illustrated in FIG. 3. By adding a skirt (300) at the intake port, dirt and debris is stirred as the swimming pool cleaning device moves. Typically, the skirt (300) is made from elastic material or makes a hinge such as an elastic axle between the skirt (300) and intake port to enable the skirt (300) to swing when it meets dirt segregated and stirs it up without affecting swimming pool cleaning device motion. The skirt has been proven to lower the effective floor clearance of the pool cleaning vehicle at the intake port. However, if the skirt (300) is effectively lowered too far, it will only push the dirt around instead of pulling it into the cleaning device. Normally, the roller brush (22) is a plastic sheet having a length equals to the circumference of the roller body (21). The roller body (21) circumference is wrapped by the roller brush (22), fixed by a number of connectors (24) along both ends of the roller brush (22), forms a roller (20). The roller brush (22) and the roller body (21) are initially tightly engaged. However, as sunlight and swimming pool chemicals make the roller brush (22) more relaxed, it will get looser and the gap between the roller body (21) and roller brush (22) will increase and the engagement will have a tendency to slip.

In order to avoid slippage, applicant herein discloses a design using a shorter roller brush (22) so that roller body (21) remains tightly wrapped by the roller brush (22), reducing the likelihood that the gap between roller brush (22) and roller body (21) will grow. By changing the design of prior brushes, Applicants herein seek to increase the roller brush life and make construction more efficient.

SUMMARY OF THE INVENTION

Accordingly, to address the problems noted above, it is an object of the invention herein to provide a roller brush positively interlocked with the roller body to prevent slippage of the brush when driven by the pool cleaning device drive motor.

To accomplish this and other objects of the invention herein the roller brush assembly in accordance with the invention herein includes, a roller body and roller brush which wraps around the roller body. The roller brush has inner surface, which is in contact with roller body outer surface. The roller body outside surface has a number of detent posts or in one embodiment grooves. The roller brush inner surface has a number of detent grooves or posts. A number of detent posts engage with a number of grooves enable positive interlock between roller body and roller brush. It will be appreciated that for the purposes of the invention, it does not matter whether the brush or the roller have the posts as long as one member has the posts and the other member has the grooves.

In one exemplary embodiment, the detent posts or detent grooves of the roller body in accordance with the invention are regularly distributed. In another exemplary embodiment, the detent posts or detent grooves of the roller body are irregularly distributed.

In another exemplary embodiment, the grooves extend through the thickness of either or both of the roller body outer surface or the roller brush inner surface.

In another exemplary embodiment, the detents do not extend through the thickness of either or both of the roller body outer surface or roller brush inner surface.

In another exemplary embodiment, the roller body in accordance with this invention is made of rigid polymer or metal and wherein the roller bush of this invention is made of elastomer.

In another exemplary embodiment, the roller bush comprises an unfolded rectangular shape having a length which matches the roller body circumference so that roller brush can wrap around the roller body. Each of the ends of the unfolded roller brush includes a detachable connector or in another embodiment, a permanent connector.

In another exemplary embodiment, the roller brush in accordance with the invention includes a connection end having a number of buckles while the other end has a number of button holes. The buckles attach to the button holes for connecting the two ends together in interlocking fashion.

In another exemplary embodiment, the roller brush in accordance with the invention has an unfolded length, which matches the length of roller body, so that roller brush wraps around the roller body.

In another exemplary embodiment, the outside surface of the roller brush has a number of flexible brushes and the brushes are evenly distributed on the surface. In another exemplary embodiment, the brushes are unevenly distributed.

It is an advantage of the roller brush assembly in accordance with this invention to provide a positive interlock between the roller brush and the roller body.

It is an additional advantage to provide a roller brush in accordance with the invention, which avoids drive slippage between the roller brush and roller body.

It is an additional advantage to provide a roller brush in accordance with the invention which provides roller brush construction which reduces the aging rate of the brush extending the life of the brush assembly and thereby lowering maintenance costs.

BRIEF DESCRIPTION OF THE DRAWING

For a further understanding of the objects and advantages of the present invention, reference should be had to the following detailed description, taken in conjunction with the accompanying drawing, in which like parts are given like reference numerals and wherein.

DETAILED DESCRIPTION OF THE INVENTION

Figure 1:
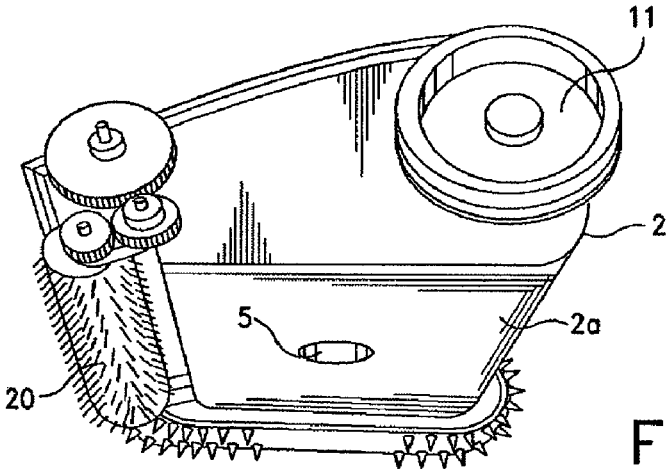
FIG. 1 (PRIOR ART)
FIG. 1 shows the existing swimming pool cleaning device construction.
Figure 2:
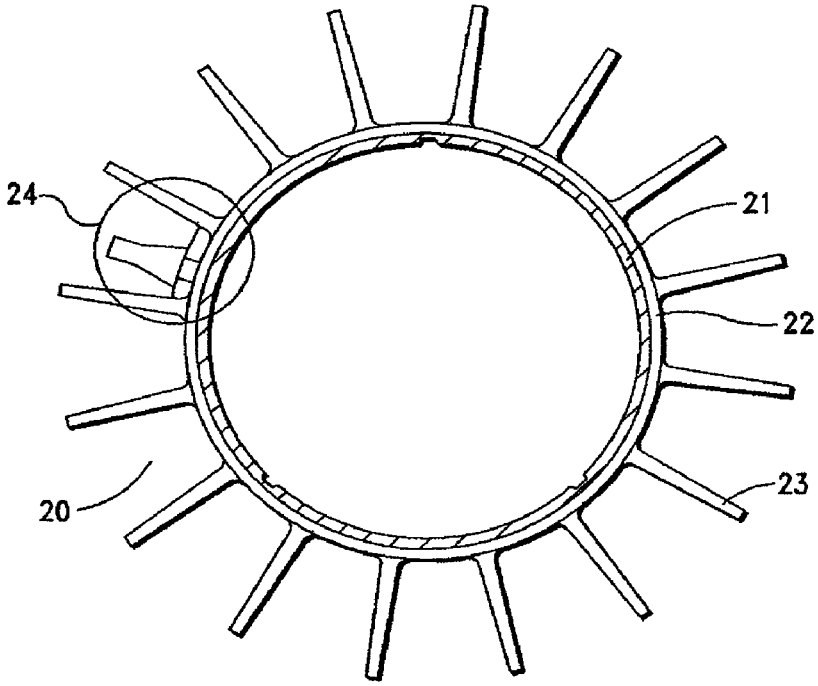
FIG. 2 (PRIOR ART)
FIG. 2 shows a sectional view of the existing swimming pool cleaning device.

To better illustrate the objects and advantages of the roller brush assembly in accordance this invention, a detailed description of the drawing is provided below. As will be appreciated by those skilled in the art, the exemplary embodiments are provided for explanation only and are not to be for purposes of limiting the scope of the invention.

Figure 3A:
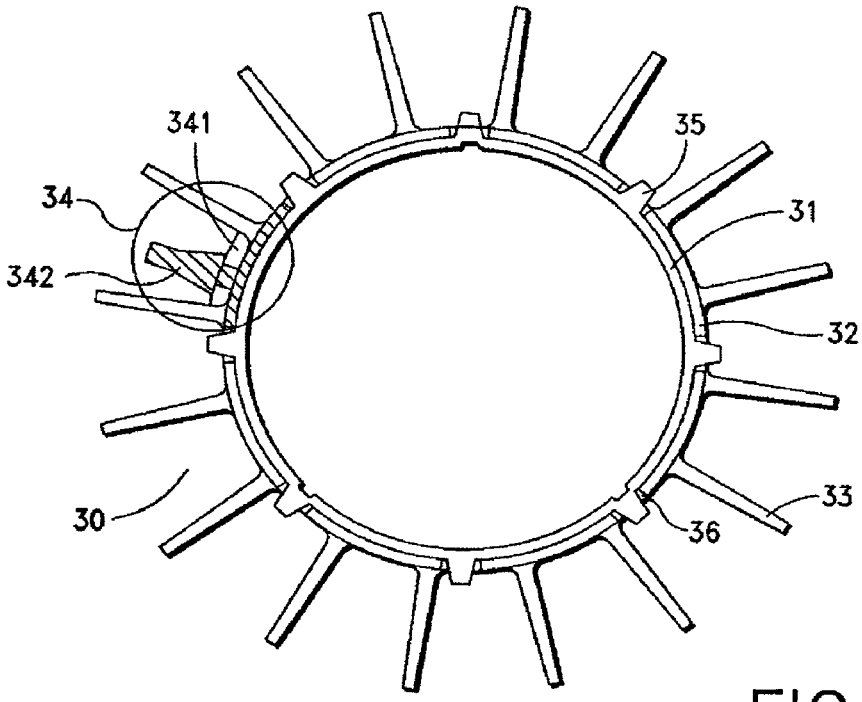
FIG. 3A shows a sectional view of an exemplary embodiment of the roller brush assembly in accordance with this invention.
Figure 3B:
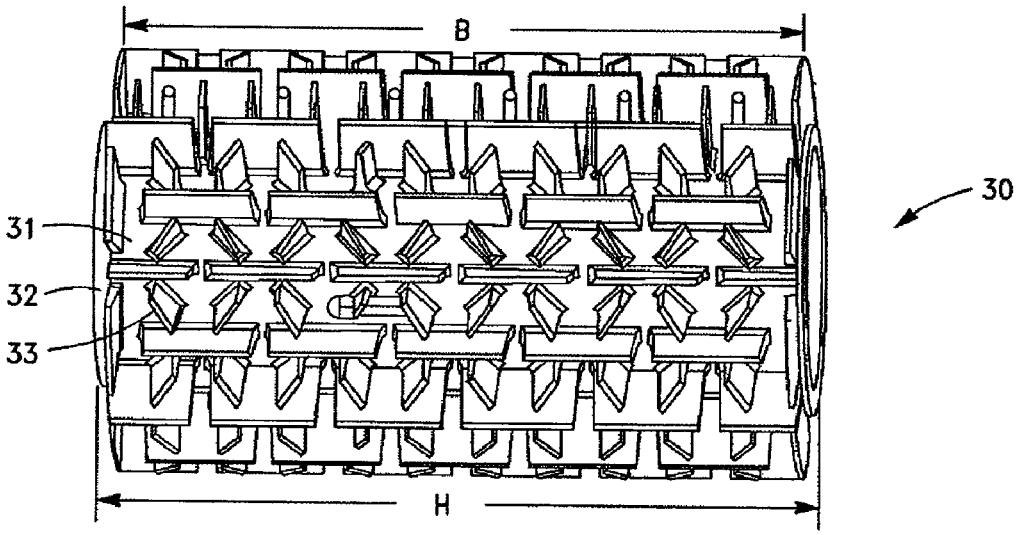
FIG. 3B is a perspective view of an exemplary embodiment of the roller brush assembly in accordance with this invention.
Figure 3C:
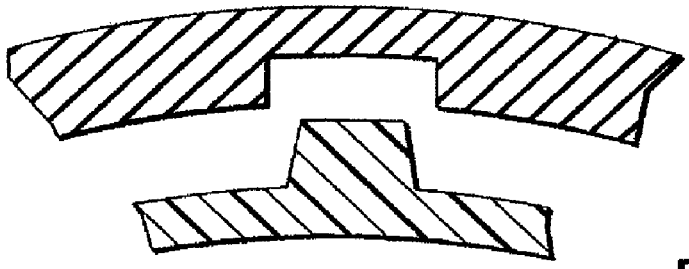
FIGS. 3C-3F illustrate exemplary embodiments for locking the brush and roller in accordance with the invention.
Figure 3D:
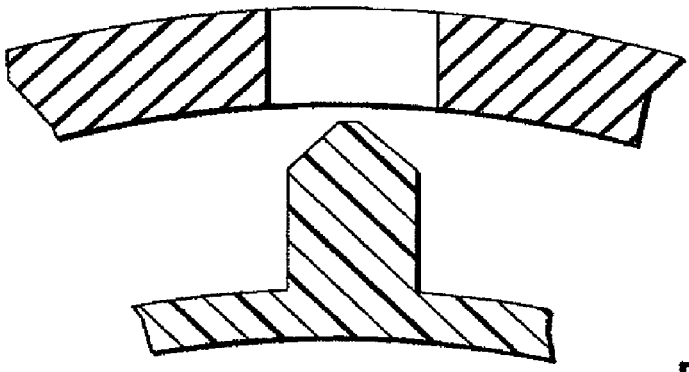
Figure 3E:
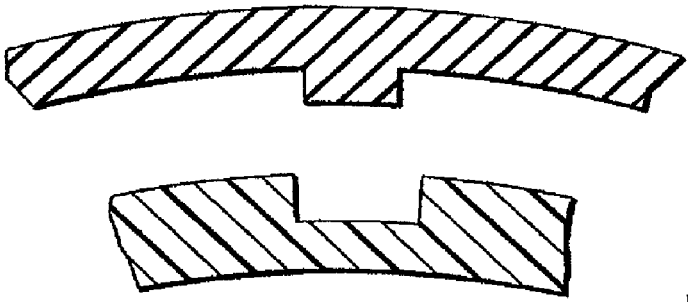
Figure 3F:
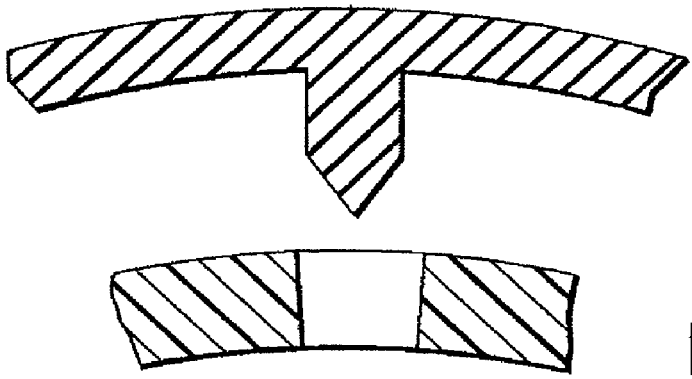

FIG. 3A and FIG. 3B illustrate sectional and perspective views of one exemplary embodiment in accordance with the invention. In the embodiment shown, the roller assembly (30) includes a rigid roller body (31) and a flexible roller brush (32). The brush 32 is wrapped around the roller body (31). In other words, the roller brush (32) inner surface is in touching contact with roller body (31) outer surface. The roller body (31) is generally in the shape of a cylinder and is made of rigid polymeric material or a metal. The roller brush (32) is generally in the shape of a flat piece and is made of elastomer such as PVC (Polyvinyl Chlorine). The roller assembly includes a body axle, which is connected and driven by a swimming pool cleaning device motor, or being jet propelled by a water pump located inside or outside the swimming pool cleaning device.

In another exemplary embodiment, the brushes (33) made of flexible material such as plastic. The brush is located on the outside surface of the roller brush (320) as in the earlier described embodiment. The brush (33) includes a number of different shapes. The brush includes a number of detent posts, which depending on the embodiment, are either evenly or unevenly distributed on the roller brush (32).

As a result of the construction of the brush (33) friction increases between swimming pool floor and the roller and increases water agitation as the roller (30) rolls along the pool surface. The increased friction causes addition dirt to be stirred up from the bottom and debris segregated on the swimming pool floor is like wise stirred up. Upon being stirred up, the dirt and debris is more easily sucked into swimming pool cleaning device for filtering.

The cleaning device includes at least one intake port for sucking up the water having the dirt and debris. Once sucked into the device, the water is filtered in the filter located in the interior of the device.

As illustrated in FIG. 3A, the roller body (31) includes a number of non-continuous detent posts. The inner surface of roller brush (32) has a number of detent grooves. In order to construct the roller assembly in accordance with the invention, the roller brush (32) is wrapped around the roller body (31) outer surface. The detent posts align with and then engage the detent grooves.

Compared with existing roller body and roller brush design which has smooth contact surface, the detent posts (35) and detent grooves (36) of this invention construction can ensure interlocking engagement between the roller body (31) and the roller brush (32). The roller brush (32) securely engages the roller body (31) without relying on roller brush (32) tension.

The roller assembly in accordance with this invention provides positive and secure connection between the roller body (31) and the roller brush (32). The engagement between the grooves and posts provides a non slip drive assuring synchronizing the roller with the brush.

As noted above, detent posts (35) and detent grooves (36) are evenly or unevenly located on roller body (31) and roller brush (32), respectively, depending on the embodiment.

In an exemplary embodiment, the detent grooves (36) on the roller brush (32) extend through the thickness of the roller brush. That is, the groove are through the roller brush (32) from the inner to the outer surface. In another embodiment, the detent grooves do not extend through the thickness of the roller brush.

The unfolded roller bush (32) defines a rectangular shape (including square shape). The length of the roller body (31) matches the circumference so that roller brush (32) can wrap around the roller body (31). Two ends of the unfolded roller brush (32) include a detachable connector. In another embodiment, the connector is permanent. The detachable connector includes, but is not limited to a clasp, a button, or screws. The permanent connector includes but is not limited to glue, or hot glue or other bonding material. In the above embodiment, the unfolded roller brush (32) includes a number of connectors (34) on both ends.

The roller body (31) has an axle. Additionally there are a number of buckles (341) one end and a number of button holes (342) on the other end. The buckles (341) engage the button holes (342) for connecting the brush (32) securely to the roller body (31).

FIG. 3B shows unfolded roller brush (32) having a length B which matches the length h of roller body (31). As a result, the roller brush (32) completely wraps around the roller body (31). This ensures additional friction and more effective power transfer from the motor to the roller. Consequently, the ability of the cleaning device to stir up dirt and debris from the pool surface is increased. In another exemplary embodiment, the unfolded roller brush (32) has a length B, which is less than the length h of roller body (31).

Figure 4:
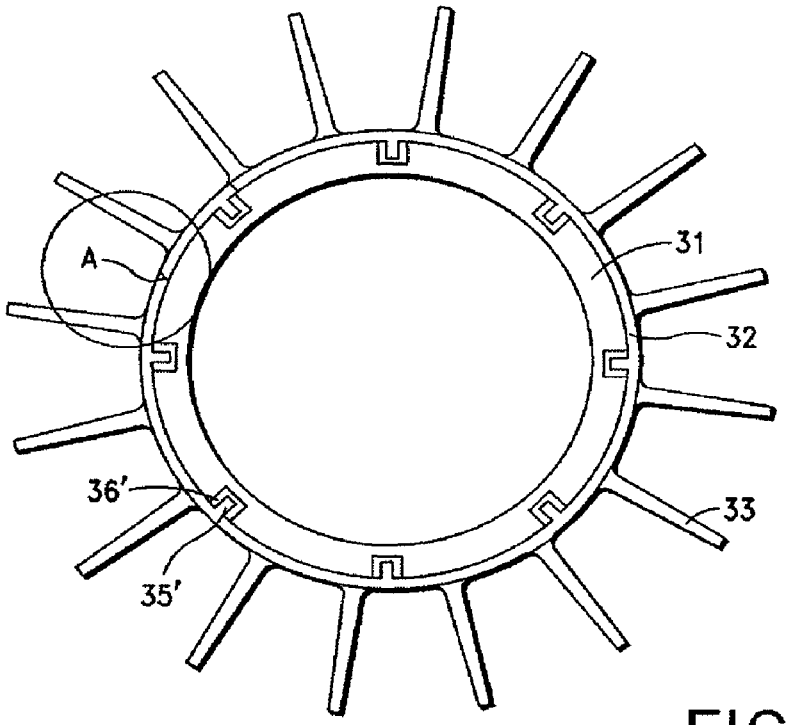
FIG. 4 shows a sectional view of another exemplary embodiment of the roller brush assembly in accordance with this invention.

FIG. 4 shows a cross sectional view of another embodiment of the roller brush assembly in accordance with the invention. The roller assembly includes a rigid roller body (31) and a flexible roller brush (32), which wraps around the roller body (31). Unlike the earlier described exemplary embodiment, the inner surface of the roller brush (32) has a number of discrete detent posts (35'), while the roller body (31) has a number of detent grooves (36') at the corresponding n location. Numbers of the detent posts (35') engage a number of detent grooves (36') allow and ensure interlocking engagement between the roller and the brush. As noted above, this type of interlocking connection allows efficient synchronization between the roller body (31) and roller brush (32).

As noted above, in one embodiment the detent posts (35') and detent grooves (36') are evenly distributed on roller brush (32) and roller body (31), respectively. While in another embodiment, the posts and grooves are unevenly distributed. Additionally, the detent grooves (36') on the roller body (31) outer surface do not extend through the thickness of the brush. In other words, the detent groove (36') is a recessed groove within the thickness of the member. As will be appreciated by those skilled in the art, in another embodiment, the detent groove (36') extends through the thickness of the member.

In the embodiment shown above, the two ends of roller brush (32) are permanently connected by adhesive glue as shown in part A of the Figure to ensure flexible roller brush (32) securely attaches to the roller body (31).

Figure 5:
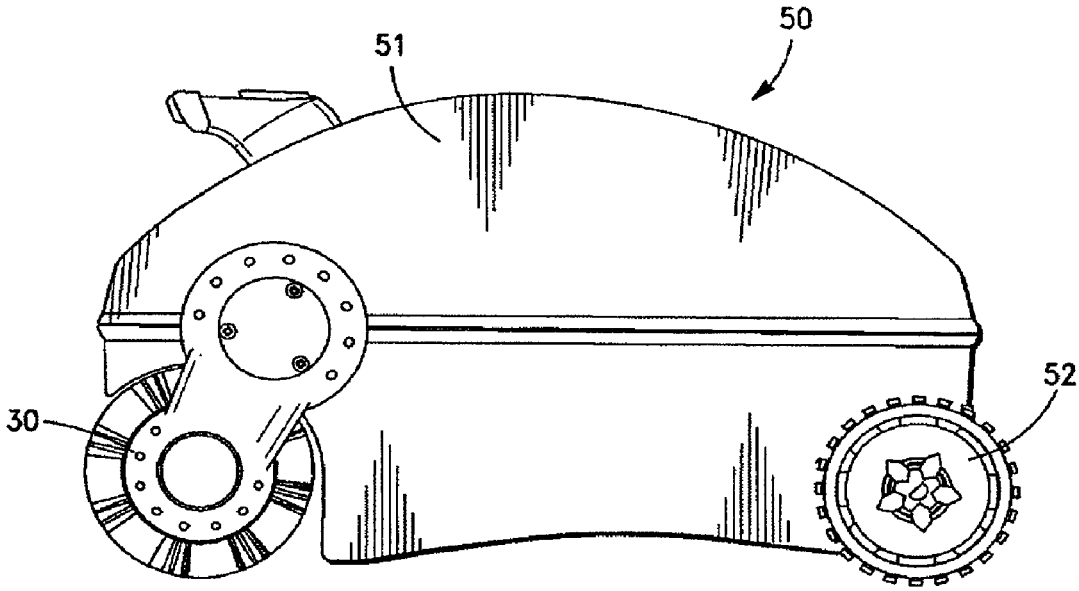
FIG. 5 is a perspective view of the swimming pool cleaning device showing a roller in accordance with this invention.

The roller assembly in accordance with this invention is used in domestic or industrial swimming pool cleaning device. The swimming pool cleaning device has at least one roller at its bottom. FIG. 5 shows the construction of a swimming pool cleaning device using this type of brush. The swimming pool cleaning device (50) consists of an outer shell (51). The front of the outer shell (51) bottom has at least one roller (30). Rear end of the outer shell (51) bottom has at least one wheel (52). The roller (30) and the wheel (51) are driven by a motor placed inside the swimming pool cleaning device (50). The motor can control roller (30) and wheel (51) speed and direction independently and therefore moving the swimming pool cleaning device (50) around on swimming pool floor. Obviously roller (30) and wheel (51) can be jet propelled by water pump inside the swimming pool cleaning device. The swimming pool cleaning device (50) can have the roller (30) on either end.

In conclusion, the roller assembly in accordance with this invention includes a number of detent posts or detent grooves on the roller body and brush, respectively. The grooves and posts match and are aligned so that the brush and roller form an interlocking connection. Because of this, the roller assembly of this invention ensures positive interlock and synchronizes drive between roller body and roller brush, avoiding slippage. This invention provides a simple construction, easy manufacture and assembly. The roller brush assembly in accordance with this invention minimizes the aging of the flexible roller brush and therefore service life is extended, lowering maintenance costs.

While the foregoing detailed description has described several embodiments of the roller brush assembly in accordance with this invention, it is to be understood that the above description is illustrative only and not limiting of the disclosed invention. It will be appreciated there are also various modifications of the assembly that are suitable for use in the exemplary embodiments discussed above and that there are numerous embodiments that are not mentioned but within the scope and spirit of this invention. Thus, the invention is to be limited only by the claims as set forth below.

What is claimed is:

1. A swimming pool cleaning device defining a roller assembly, the roller brush assembly, comprising a roller brush and a roller body;

the roller brush having a plurality of grooves and in an unfolded stated has a rectangular shape, one end of the roller brush having a plurality of buckles and the other end having a plurality of mating button holes and the buckles are engageable with the button holes to form an interlocking connection;

the roller body having a plurality of posts;

the number of posts corresponds to the number of grooves; and the posts align with the grooves and form an interlocking connection between the roller brush and the roller body, whereby upon movement of the roller body, the roller brush moves directly and is synchronized with the roller body.

2. The roller assembly according to claim 1, wherein the posts are grooves evenly distributed.

3. The roller assembly according to claim 1, wherein the groove extend through the thickness of the roller brush.

4. The roller assembly according to claim 1, wherein the grooves do not extend through the thickness of the roller brush.

5. The roller assembly according to either claim 4, wherein the roller body is made of a rigid polymer.

6. The roller assembly according to claim 1, wherein the unfolded roller brush width approximates the roller body width in order for the roller brush to approximately wrap the roller body circumference.

7. The roller assembly according to claim 1, wherein unfolded roller brush width is less than the roller body width in order for the roller brush to wrap the roller body circumference.

8. The roller assembly according to claim 1, wherein the roller brush includes a number of flexible brushes protruding from the surface of the brush.

9. The roller assembly as set forth in claim 1, wherein the posts and grooves are unevenly distributed.

10. The roller assembly as set forth in claim 1, wherein the roller body is made from metal.

11. The roller assembly as set forth in claim 1, wherein the roller brush is made from an elastomeric material.

12. The roller assembly as set forth in claim 1, wherein the roller brush wraps around the outside circumference of the roller body and is detachable from the roller body.

13. The roller assembly as set forth in claim 1, wherein the roller brush wraps around the outside circumference of the roller body and is permanently connected to the roller body.

14. A swimming pool cleaning device defining a roller assembly, the roller brush assembly, comprising:

a roller brush and a roller body;

the roller brush having a plurality of grooves and in an unfolded stated has a rectangular shape, the length of the unfolded roller brush matches the circumference of roller body;

the number of posts corresponds to the number of grooves; and the posts align with the grooves and form an interlocking connection between the roller brush and the roller body, whereby upon movement of the roller body, the roller brush moves directly and is synchronized with the roller body.

* * * * *